US006117515A

United States Patent [19]

Brunson et al.

[11] Patent Number: 6,117,515

[45] **Date of Patent: *Sep. 12, 2000**

[54] NON-PARTICULATING AND LOW PARTICULATING DISPOSABLE PRODUCTS FOR USE IN CLEAN ROOM ENVIRONMENTS

[75] Inventors: Kevin K. Brunson, Argyle; Marc E. Pinney, Grapevine, both of Tex.

[73] Assignee: Kimberly-Clark Worlwide, Inc., Roswell, Ga.

[ * ] Notice: This patent is subject to a terminal disclaimer.

[21] Appl. No.: 09/016,509

[22] Filed: Jan. 30, 1998

Related U.S. Application Data

[60] Provisional application No. 60/037,037, Jan. 31, 1997.

[51] Int. Cl.[7] ..... B32B 3/02; B32B 3/04

[52] U.S. Cl. ..... 428/83; 442/397; 442/399; 442/110; 428/122

[58] Field of Search ..... 156/157, 159; 442/110, 397, 399, 401, 400; 428/83, 122; 128/206.19

[56] References Cited

U.S. PATENT DOCUMENTS

| | | | |
|---|---|---|---|
| 1,292,095 | 1/1919 | Schwartz | 128/206.13 |
| 2,012,505 | 8/1935 | Goldsmith | 128/863 |
| 2,029,947 | 2/1936 | Schmitt et al. | 128/863 |
| 2,923,298 | 2/1960 | Dockstader et al. | 602/47 |
| 3,170,461 | 2/1965 | Watts, Jr. | 128/863 |
| 3,490,447 | 1/1970 | Jackson | 128/863 |
| 3,603,315 | 9/1971 | Becker | 128/206.19 |
| 3,613,678 | 10/1971 | Mayhew | 128/206.19 |
| 3,616,154 | 10/1971 | Dow et al. | 428/134 |
| 3,620,214 | 11/1971 | Thackston | 128/206.19 |
| 3,664,335 | 5/1972 | Boucher et al. | 128/206.16 |
| 3,688,768 | 9/1972 | Reimschussel et al. | 128/206.12 |
| 3,779,244 | 12/1973 | Weeks, Jr. et al. | 128/206.19 |
| 3,884,227 | 5/1975 | Lutz | 128/206.19 |
| 3,888,246 | 6/1975 | Lauer | 128/201.17 |
| 3,929,135 | 12/1975 | Thompson | 604/385.1 |
| 3,953,566 | 4/1976 | Gore | 264/505 |
| 4,011,067 | 3/1977 | Carey, Jr. | 55/354 |
| 4,064,876 | 12/1977 | Mulchi | 128/206.15 |
| 4,187,390 | 2/1980 | Gore | 174/102 R |
| 4,300,549 | 11/1981 | Parker | 128/206.19 |

(List continued on next page.)

FOREIGN PATENT DOCUMENTS

| | | |
|---|---|---|
| 0032422 | 7/1981 | European Pat. Off. . |
| 0391726A2 | 10/1990 | European Pat. Off. . |
| 0391725B1 | 6/1994 | European Pat. Off. . |
| 0606686A1 | 7/1994 | European Pat. Off. . |
| 892262 | 3/1962 | United Kingdom . |
| 1473924 | 5/1977 | United Kingdom . |
| 2028664 | 3/1980 | United Kingdom . |
| 2103491 | 2/1983 | United Kingdom . |
| 8103266 | 11/1981 | WIPO . |
| 9108829 | 3/1991 | WIPO . |

OTHER PUBLICATIONS

Brochure for Dupont® Sontara® Criticlean® Contamination Control Fabrics, Refs. dated 1995, 2 pages, no month.

Trademark Registration Searches for Cerex, Delnet, Gore–Tex, Tyvek Protectvivewear, and Tyvek, 1996, 8 pages, no month.

*Primary Examiner*—Blaine Copenheaver
*Assistant Examiner*—John J. Guarriello
*Attorney, Agent, or Firm*—Dority & Manning, P.A.

[57] ABSTRACT

Disposable garments, protective clothing and accessory items formed from one or more layers of fractured plastic film or treated nonwoven material are provided for use in clean rooms and similar working environments. The use of non-particulating or low particulating fractured plastic films and treated nonwoven materials reduces particulate contamination resulting from wearing the associated garment or using the accessory item in a clean room environment. Samples of disposable clean room products may be tested in a manner that closely approximates the intended application for the respective disposable clean room product to provide a more realistic measure of particulate emission rates during actual wear or use.

22 Claims, 4 Drawing Sheets

U.S. PATENT DOCUMENTS

| | | | |
|---|---|---|---|
| 4,382,440 | 5/1983 | Kapp et al. | 128/201.25 |
| 4,454,881 | 6/1984 | Huber et al. | 128/206.15 |
| 4,600,002 | 7/1986 | Maryyanek et al. | 128/206.19 |
| 4,606,341 | 8/1986 | Hubbard et al. | 128/206.19 |
| 4,635,628 | 1/1987 | Hubbard et al. | 128/201.17 |
| 4,688,566 | 8/1987 | Boyce | 128/206.19 |
| 4,802,473 | 2/1989 | Hubbard et al. | 128/206.19 |
| 4,807,619 | 2/1989 | Dyrud et al. | 128/206.16 |
| 4,850,347 | 7/1989 | Skov | 128/206.16 |
| 4,856,509 | 8/1989 | Lemelson | 128/206.19 |
| 4,883,052 | 11/1989 | Weiss et al. | 128/205.27 |
| 4,888,229 | 12/1989 | Paley et al. | 428/192 |
| 4,920,960 | 5/1990 | Hubbard et al. | 128/206.12 |
| 4,965,887 | 10/1990 | Paoluccio et al. | 2/9 |
| 4,969,457 | 11/1990 | Hubbard et al. | 128/206.12 |
| 5,008,961 | 4/1991 | Hubbard et al. | 2/209.3 |
| 5,150,703 | 9/1992 | Hubbard et al. | 128/206.12 |
| 5,240,479 | 8/1993 | Bachinski | 96/17 |
| 5,322,061 | 6/1994 | Brunson | 128/206.13 |
| 5,374,458 | 12/1994 | Burgio | 428/36.1 |
| 5,383,450 | 1/1995 | Hubbard et al. | 128/201.23 |
| 5,467,765 | 11/1995 | Maturaporn | 128/206.19 |
| 5,553,608 | 9/1996 | Reese et al. | 128/206.24 |
| 5,561,863 | 10/1996 | Carlson, II | 2/206 |
| 5,596,985 | 1/1997 | Collier | 128/206.19 |
| 5,699,792 | 12/1997 | Reese et al. | 128/206.19 |
| 5,803,075 | 9/1998 | Yavitz | 128/206.25 |

FIG. 9
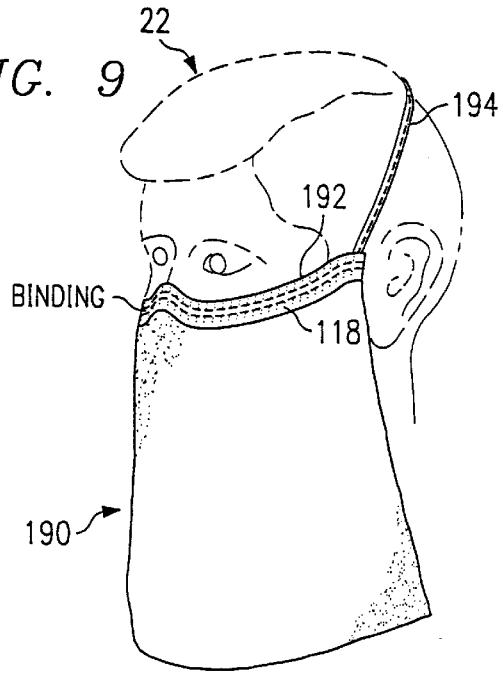
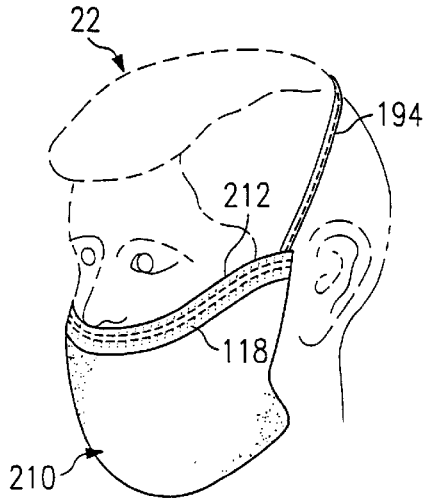
FIG. 10
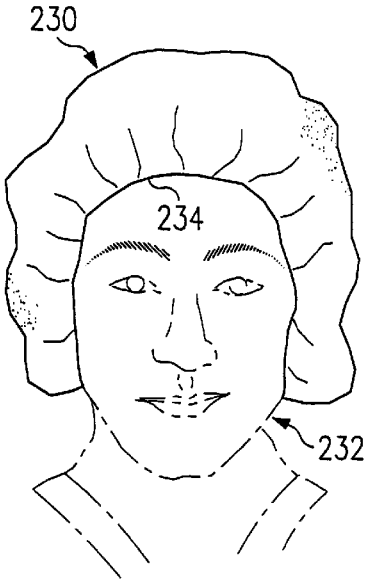
FIG. 11
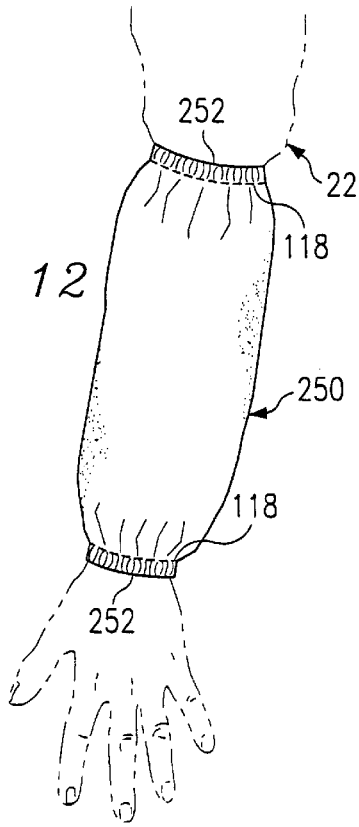
FIG. 12
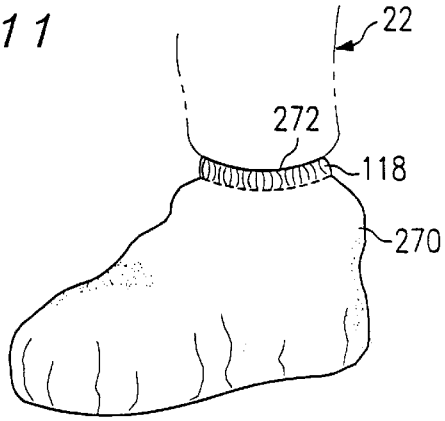
FIG. 13

NON-PARTICULATING AND LOW PARTICULATING DISPOSABLE PRODUCTS FOR USE IN CLEAN ROOM ENVIRONMENTS

RELATED APPLICATIONS

This is a continuing application claiming priority from U.S. Provisional Patent Application Ser. No. 60/037,037 filed Jan. 31, 1997, which was incorporated by reference for all purposes within this applicaiton.

This application is related to U.S. patent application Ser. No. 08/499,063 filed Jul. 6, 1995, entitled Disposable Face Mask with Enhanced Fluid Barrier (U.S. Pat. No. 5,724,964), U.S. patent application Ser. No. 08/491,137 filed Jul. 7, 1995, entitled Disposable Aerosol Mask with Face Shield (U.S. Pat. No. 5,765,556), U.S. patent application Ser. No. 08/686,348 filed Jul. 25, 1996, entitled Disposable Shoe Cover (combined with Ser. No. 09/069,299; allowed); and U.S. Pat. No. 5,699,792 entitled Face Mask with Enhanced Facial Seal.

TECHNICAL FIELD OF THE INVENTION

This invention relates generally to disposable products which may be worn or used by personnel working in a clean room environment. More particularly, but not by way of limitation, this invention relates to non-particulating and low particulating disposable products which form a barrier between a wearer and the wearer's working environment to allow maintaining low levels of contamination as required for each clean room environment.

BACKGROUND OF THE INVENTION

Many of the critical fabricating procedures associated with producing advanced electronic equipment such as microprocessors and other very large scale integrated (VLSI) circuits are conducted in clean room environments. Complex genetically engineered DNA sequences are also often produced in clean room environments. Continuing advances in fabricating VLSI circuits from a wide variety of semiconductor materials and the remarkable breakthroughs in genetic engineering, have resulted in cleanliness standards of approximately one thousand (1,000) particles per cubic meter of air which may have been acceptable only ten years ago, being unacceptable today. For example, many current VLSI circuits require fabrication in a clean room environment with contamination levels in the range of approximately one to ten particles per cubic meter of air or less.

As acceptable standards for particulate contamination in clean room environments have become more stringent, protective clothing and garments worn by personnel working in such environments have become more elaborate and often more expensive. Typically, clean room garments and accessory items are fabricated from materials which allow reuse following appropriate laundering or cleaning procedures. The combined cost associated with initial purchase, cleaning and storing of reusable garments and accessory items, especially for working environments with very low levels of acceptable particulate contamination, has become a significant factor in the total cost of fabricating the final product in a clean room environment. In several industries, personnel hygiene and potentially hazardous contamination of clean room garments and accessory items are of increasing concern.

A typical clean room garment in 1970 would be a white lab coat or jacket fabricated from high quality cotton. In 1996 this same clean room garment may be fabricated from one or more layers of expanded polytetrafluoroethylene (PTFE) and sandwiched between two or more layers of close knit polyester or woven textile type material. Reusable clean room garments are often formed from such materials by cutting and sewing. Various types of tape and other adhesives have been used to cover the resulting seams to further minimize potential particulate contamination of the clean room environment. One type of material used for such applications includes GORE-TEX plastic films available from W. L. Gore & Associates, Inc., 555 Paper Mill Road, P.O. Box 9329, Newark, Del. 19714.

Until recently, most clean room garments and accessory items were reusable and required cleaning after each use. The effectiveness of such garments and accessory items for clean room applications has often been determined by using the Helmke drum test. Some manufacturers refer to the particulate levels generated by the Helmke drum testing of new clean room garments and accessory items in connection with marketing such clean room garments and accessory items. However, Helmke drum testing is seldom, if ever, performed on clean room garments and accessory items after several cycles of reuse and cleaning.

During the past few years, more disposable products have been used in clean room applications. Many of these disposable products are essentially the same products as used in the medical and healthcare industry. TYVEK® fabrics, which may be formed at least in part from polyethylene fibers and are available from E.I. duPont Nemours and Company, have been increasingly used in fabricating disposable clean room products. Polyolefin based materials have also been increasingly used for clean room applications. DuPont currently offers clean room wiping materials fabricated from Sontara® CritiClean® fabrics.

SUMMARY OF THE INVENTION

In accordance with teachings of the present invention, disposable garments and accessory items for use in a clean room environment are fabricated from non-particulating and low particulating materials to address shortcomings of garments and accessory items previously associated with clean room environments. One aspect of the present invention includes fabricating a disposable clean room garment or accessory item from one or more layers of fractured plastic film and/or treated nonwoven materials having very low rates of particulate emissions. For some applications each garment or accessory item may be fabricated in its own clean room environment to minimize particulate contamination. For other applications one or more layers of material may be cleaned prior to fabrication of the disposable clean room product. Alternatively, the resulting disposable clean room product may be cleaned after fabrication has been completed to minimize particulate contamination.

Technical advantages of the present invention include minimizing the use of nonwoven materials in fabricating disposable garments and/or accessory items for use in a clean room environment. For some disposable clean room products, nonwoven materials may be effectively replaced by fractured plastic films. For other applications, nonwoven materials may be incorporated within a disposable clean room product in accordance with teachings of the present invention to substantially reduce or eliminate any opportunity for particulate matter to escape from the nonwoven materials into the surrounding clean room environment. Disposable clean room products fabricated from non-particulating and low particulating materials in accordance with teachings of the present invention maintain a substantially constant, low level of particulate emissions while being used in a clean room environment. Clean room products fabricated from reusable materials generally have an increased particulate emission rate over time. Increased particulate emission rates are caused by wear and abrasion of the reusable material and/or increased accumulation of particulate contaminants within the respective reusable clean room product.

Further technical advantages of the present invention include improved performance in accordance with more accurate test methods and procedures which more closely approximate the actual performance of a clean room product in its intended working environment with respect to particulate contamination generated by the respective clean room product. For some applications the level of particulate contamination produced by disposable clean room products fabricated in accordance with teachings of the present invention may be less than the level of particulate contamination which will pass through a typical HEPA filter system used to supply air to the associated clean room. Performing particulate emission testing in accordance with teachings of the present invention more accurately represents actual performance in a clean room environment as compared to traditional Helmke drum test results.

A further aspect of the present invention includes a disposable clean room product having multiple layers of non-particulating or low particulating fractured plastic film. For some applications, one or more strips of nonwoven material may be placed on portions of the disposable clean room product adjacent to sensitive areas such as the wearer's face to provide increased comfort during extended periods of using the associated disposable clean room product. For other applications involving potentially hazardous liquids and/or aerosols, the disposable clean room product may be fabricated from one or more layers of fractured plastic film material that prevent liquid penetration from the exterior of the respective product. This feature may be particularly important for face masks, face veils, beard covers, head covers and other types of disposable garments placed adjacent to the wearer's head and face.

Further technical advantages of the present invention include providing lightweight, disposable, low cost clean room products which do not measurably contribute to particulate contamination within a clean room environment and may therefore be used in clean room environments with extremely low levels of allowable particulate contamination. Fabricating disposable clean room products from non-particulating and low particulating materials in accordance with teachings of the present invention provides the desired level of breathability and protection for the wearer depending upon the intended application for each product while substantially reducing or eliminating particulate emissions from the respective product. The use of fractured plastic films in accordance with teachings of the present invention will allow water vapor and moisture to permeate away from a wearer or user while blocking the escape of particulate contamination into the surround clean room environment. The present invention allows fabrication of disposable clean room products with particulate emission rates compatible with allowable levels of particulate contamination in the associated clean room environment while at the same time providing a cost effective product which may be comfortably worn or used for extended periods of time in the associated clean room environment.

BRIEF DESCRIPTION OF THE DRAWINGS

For a more complete understanding of the present invention and the advantages thereof, reference is now made to the following descriptions taken in conjunction with the accompanying drawings, in which:

FIG. 9 is a schematic drawing showing a perspective view of a face veil worn on the head of a wearer and fabricated from non-particulating or low particulating disposable materials in accordance with teachings of the present invention for use in a clean room environment;

FIG. 10 is a schematic drawing showing a perspective view of a beard cover worn on the head of a wearer and fabricated from non-particulating or low particulating disposable materials in accordance with teachings of the present invention for use in a clean room environment;

FIG. 11 is a schematic drawing showing a perspective view of a head cover worn on the head of a wearer and fabricated from non-particulating or low particulating disposable materials in accordance with teachings of the present invention for use in a clean room environment;

FIG. 12 is a schematic drawing showing a perspective view of a sleeve protector worn on the arm of a wearer and fabricated from non-particulating or low particulating disposable materials in accordance with teachings of the present invention for use in a clean room environment; and FIG. 13 is a schematic drawing showing a perspective view of a shoe cover worn on the foot of a wearer and fabricated from non-particulating or low particulating disposable materials in accordance with teachings of the present invention for use in a clean room environment.

DETAILED DESCRIPTION OF THE INVENTION

Figure 1:
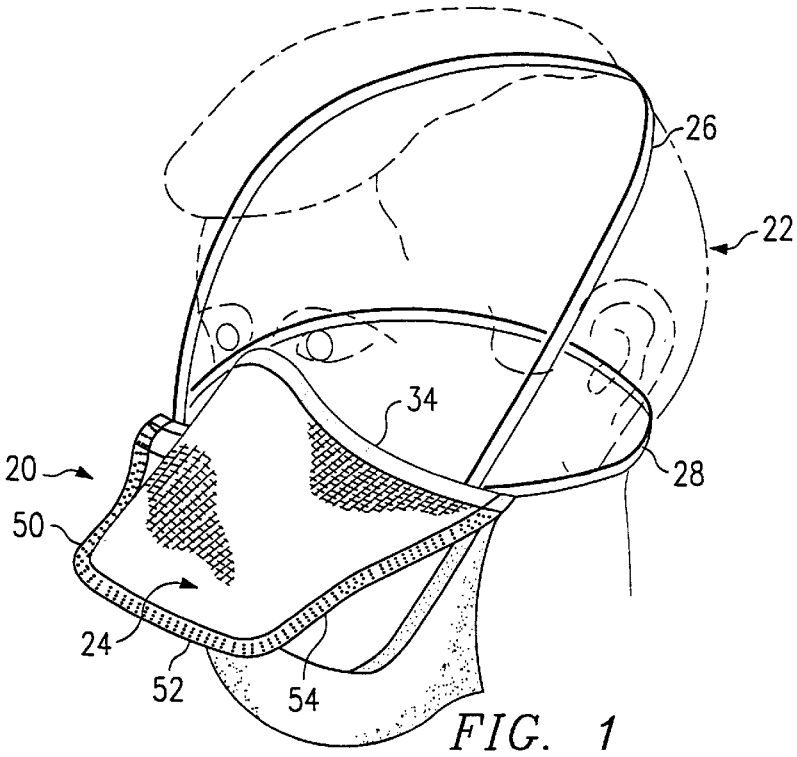
FIG. 1 is a schematic drawing showing a perspective view of a disposable face mask or disposable respirator having a gap guard on the head of a wearer and fabricated from non-particulating or low particulating materials in accordance with teachings of the present invention for use in a clean room environment.

The preferred embodiments of the present invention and its advantages are best understood by referring to FIGS. 1–13 of the drawings, like numerals being used for like and corresponding parts of the various drawings.

For purposes of this application, the terms "disposable clean room product" and "disposable clean room products" are intended to include disposable clothing and protective garments including, but not limited to, face veils, face masks, beard covers, head covers, shoe covers, respirators, gowns, trousers, sleeve protectors, hoods (with and without shoulder covers), leg protectors, lab coats and coveralls fabricated from one or more layers of non-particulating or low particulating material in accordance with teachings of the present invention for use in a clean room environment. The terms "disposable clean room product" and "disposable clean room products" are also intended to include accessory items, including but not limited to towels, wipes, absorbent pads, equipment covers, and bags fabricated from one or more layers of non-particulating or low particulating material in accordance with teachings of the present invention for use in a clean room environment. Unless expressly stated otherwise, the terms "disposable clean room product" and "disposable clean room products" are used in the claims to indicate disposable clothing, protective garments and accessory items which may be used in a clean room environment to reduce particulate contamination. Representative examples of some of these disposable clean room products are shown in FIGS. 9–13 which will be discussed later in more detail.

The terms "disposable face mask(s)" and "face mask(s)" are intended to include any disposable surgical style face mask or disposable industrial-type respirator. For some applications such face masks preferably form a substantially fluid-tight seal between the periphery of the respective face mask or respirator and adjacent portions of the wearer's face. Other types of disposable respirators which may be satisfactorily fabricated in accordance with teachings of the present invention include modified cone-style face masks such as shown in U.S. Pat. No. 3,688,768 entitled Disposable Face Mask Respirator and method of Making Same. This patent is incorporated by reference for all purposes within this application.

The term "substantially fluid-tight seal" is used to indicate that the acceptable amount of leakage or bypass fluid flow between the periphery of the respective face mask or respirator and adjacent portions of the wearer's face is dependent upon the intended clean room environment. For some clean room environments with very low allowable levels of particulate contamination and/or hazardous conditions such as dangerous airborne pathogens, only zero leakage may be acceptable. For other less stringent conditions, a somewhat higher amount of leakage may be acceptable between the periphery of the respective face mask or respirator and adjacent portions of the wearer's face.

The term "aerosols" is intended to mean insoluble liquids or particulate matter frequently associated with microbial solutions. The term "fluid" is intended to mean any gas, liquid, or mixture of gases and liquids along with various types of particulate matter and aerosols which may be entrained with such fluids.

The terms "breathable" and "breathability" are used with respect to evaluating materials for fabricating a wide variety of disposable clean room products. Therefore, acceptable levels of breathability will vary considerably depending upon each product and its intended application. Requirements for breathability satisfactory for fabricating a face mask or respirator are substantially different from requirements for materials used to fabricate clothing such as lab coats, head coverings, sleeve protectors and other garments which may also be described as "breathable" but require only a relatively small amount of air passage therethrough as compared to face masks and respirators. For example, face masks often have filter bodies formed from materials with breathability measured in the range of approximately thirty-two (32) liters of air per minute with a differential pressure of two (2) millimeters of water while a head covering may be considered breathable with air exchange rate substantially less than one (1) liter of air per minute.

The terms "fractured plastic film" and "fractured plastic films" are intended to include a wide variety of polymeric, synthetic plastic compounds which may be formed into thin, flex sheets or continuous rolls from the respective compound. Conventional plastic film may have a thickness in the range of 0.011 cm to 0.033 cm without holes or cracks to form an efficient barrier to molecules of air, water vapor, oxygen, and other fluids. In contrast to such conventional plastic films, fractured plastic films include a large number of holes or cracks which may be selectively designed to pass limited quantities and/or types of fluids therethrough. Examples of fractured plastic films satisfactory for use in the present invention are shown in U.S. Pat. No. 3,616,154 entitled Nonwoven Open Work Net Structure of Thermoplastic Material; U.S. Pat. No. 3,929,135 entitled Absorbative Structure Having Tapered Capillaries; U.S. Pat. No. 3,953,566 entitled Process for Producing Porous Products; and U.S. Pat. No. 4,187,390 entitled Porous Products and Process Therefor. These patents are incorporated by reference for all purposes within this application.

For purposes of this application, the terms "non-particulating" and "low particulating" are used to describe the particulate emission characteristics of materials selected for use in fabricating disposable clean room products in accordance with teachings of the present invention. For some applications, a selected material may have a particulate emission rate of zero or at least a particulate emission rate which is low enough to be undetectable by available particulate detection equipment. For other applications which may involve a more harsh working environment or extensive abrasion and wear, the same material may have a low particulate emission rate which is compatible with the allowable level of particulate contamination in the associated clean room environment. Therefore, a layer of fractured plastic film may be described as "non-particulating" when used in one application and described as "low particulating" when used in another, more harsh application.

For purposes of this application, the term "treated nonwoven material" is intended to include any nonwoven material which has been treated by either a chemical process or a mechanical process to substantially reduce or eliminate the emission of particulate contamination from the resulting nonwoven material. Examples of such mechanical treatments include, but are not limited to, searing of the associated nonwoven materials and/or heavy calendaring of the nonwoven material. Examples of chemically treating include, but are not limited to, plastic coating or adhesive bonding of nonwoven fibers.

Disposable face masks 20 and 60 incorporating various features of the present invention are shown respectively in FIGS. 1 and 2 and FIGS. 3 and 4. Face masks 20 and 60 may be used to block liquids and particulate matter from normal breathing of a wearer and/or from covered portions of a wearer's face from contaminating the surrounding environment. For some applications, face masks 20 and 60 may also include one or more layers of material to retard the flow of potentially hazardous bacteria, liquids, aerosols, chemicals and/or other dangerous elements from the exterior of the respective face mask to the nose and mouth of wearer 22.

Disposable face mask 20 may sometimes be referred to as a "disposable respirator." The present invention allows manufacturing, from non-particulating disposable materials, a face mask or respirator having a fluid-tight seal with portions of the wearer's face and the necessary degree of filtration protection depending upon the anticipated clean room environment while enhancing comfort during long periods of wearing the respective face mask or respirator. Further information concerning disposable face mask 20 may be found in U.S. Pat. No. 5,322,061, entitled Disposable Aerosol Mask. Further information concerning disposable face mask 60 may be found in U.S. Pat. No. 5,553,608, entitled Face Mask with Enhanced Fluid Seal and Method. Both of these patents are incorporated by reference for all purposes within this application.

Face mask 20 is shown in FIG. 1 positioned on the face of wearer 22, illustrated in ghost lines. Face mask 20 includes filter body 24 secured to wearer 22 by resilient securing members or headbands 26 and 28. Filter body 24 comprises an upper portion 30 and a lower portion 32 which each have a generally trapezoidal configuration. Upper and lower portions 30 and 32 preferably have matching exterior dimensions and shape. Upper and lower portions 30 and 32 may be bonded together by heat and/or ultrasonic sealing edges 50, 52 and 54 of filter body 24. Head bands 26 and 28 may be attached between adjacent ends of top edge 34 and bottom edge 38 during ultrasonic bonding of edges 50, 52 and 54 of filter body 24. Bonding in this manner adds important structural integrity to face mask 20 and reduces particulate emissions.

Filter body 24 includes an opening defined in part by top edge 34 with elongated malleable member 36 disposed adjacent thereto. Malleable member 36 is provided so that top edge 34 of face mask 20 can be configured to closely fit the contours of the nose and cheeks of wearer 22. Malleable member 36 is often constructed from an aluminum strip with a rectangular cross-section, but may also be a moldable or malleable steel or plastic member. Blow-by associated with normal breathing of wearer 22 is substantially eliminated by properly selecting the dimensions and location of malleable strip 36 with respect to top edge 34.

Top edge 34 of upper portion 30 and bottom edge 38 of lower portion 32 cooperate with each other to define the opening in filter body 24 and the periphery of face mask 20 which contacts the face of wearer 22. The present invention allows optimizing the barrier formed between the periphery of face mask 20 and the face of wearer 22 and the capability of face mask 20 to prevent the passage of liquids, particulate matter and/or aerosols through filter body 24 while minimizing resistance to normal breathing of wearer 22 when wearing face mask 20. The present invention also allows including one or more layers of non-particulating material within filter body 24 to reduce particulate emissions from face mask 20 to the surrounding environment.

For some applications securing members 26 and 28 may be constructed from resilient polyurethane, elastic rubber or other resilient materials. Preferably, securing members 26 and 28 will be fabricated from non-particulating resilient materials such as polyurethane or polyisoprene. For one application knitted elastic made from two single filaments of thread wrapped around a single strand of lycra may be satisfactorily used to form securing members 26 and 28. The use of securing members 26 and 28 substantially improves the fluid barrier formed between the periphery of face mask 20 and the face of wearer 22.

Head bands 26 may be placed over the top of the head of wearer 22, as illustrated in FIG. 1, in alignment with bottom edge 38 of face mask 20 so that a direct force is exerted along that line urging bottom edge 38 into sealing engagement with the chin of wearer 22. Similarly, head band 28 may be positioned around the lower base of the skull of wearer 22 in direct alignment with top edge 34 of face mask 20 and thus placing a force thereon which tends to move top edge 34 into tighter sealing engagement with the nose and cheeks of wearer 22.

In addition to a tight peripheral seal, face mask 20 must have good breathability characteristics. That is, face mask 20 should require a low differential in pressure to permit air to flow easily through filter body 24 despite the fact that layers 40, 42 and 44 may be formed from materials which will filter one micron and smaller particles. A low differential pressure for air flow indicates good breathability through a face mask 20 and helps to maintain the desired fluid seal between the periphery of face mask 20 and the face of wearer 22.

Figure 2:
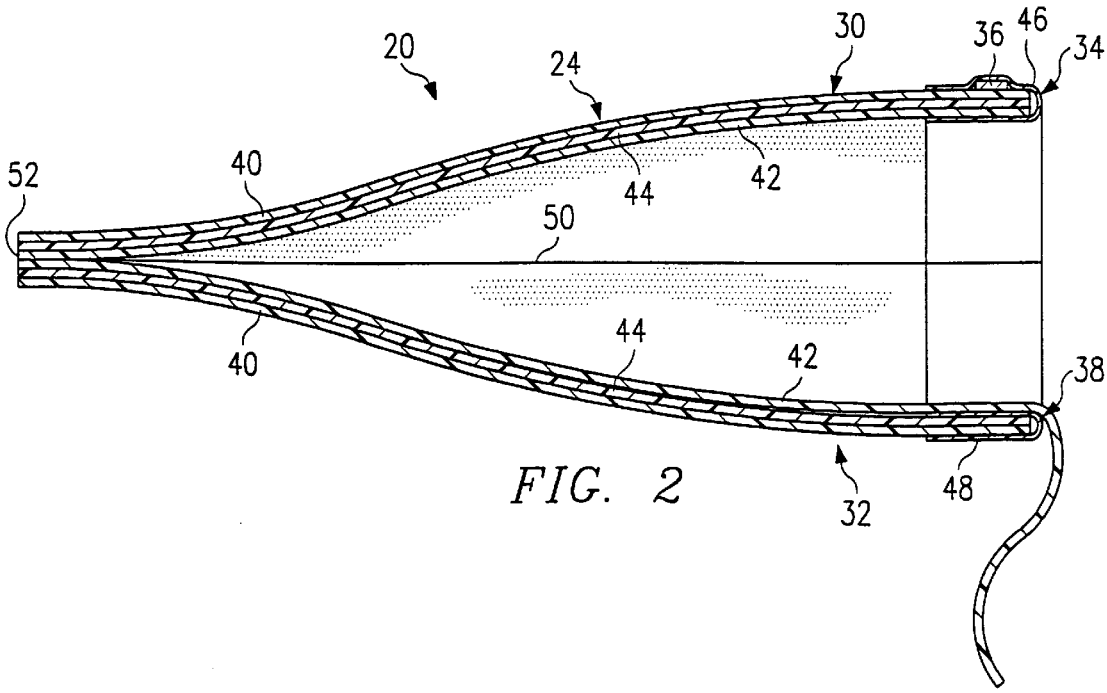
FIG. 2 is a schematic drawing in section and in elevation with portions broken away showing the disposable face mask or disposable respirator of FIG. 1, including the gap guard extending therefrom to prevent particulate contamination from the neck of a wearer escaping into an associated clean room environment.

As illustrated in FIG. 2, upper and lower portions 30 and 32 each include outer layer 40 which may be fabricated from various nonwoven materials such as spun-bonded polypropylene, bicomponent and/or thermal bonded materials such as polyethylene or polypropylene, cellulastic tissue, or spun-bonded polyester. For some applications, outer layer 40 may have a basis weight range of 0.5 ounces per yard to 1.0 ounces per yard with 0.9 ounces per yard a preferred basis weight for outer layer 40. For clean-room environments with very low levels of allowable particulate contamination, outer layer 40 may be fabricated from a fractured plastic film such as shown in U.S. Pat. No. 3,616,154 entitled Nonwoven Openwork Net Structure Of Thermoplastic Material. DELNET® plastic films satisfactory for use with the present invention are available from Applied Extrusion Technologies, P.O. Box 582, Middletown, Del. 19709.

Upper and lower portions 30 and 32 of filter body 24 each include an inner layer 42 which may be fabricated from various nonwoven materials such as bicomponent polyethylene and/or polypropylene. Inner layer 42 may also be fabricated from polyester and/or polyethylene material or cellulastic tissue. For some applications, inner layer 42 may have a basis weight of approximately one-half an ounce per yard. For clean room environments with very low levels of allowable particulate contamination, inner layer 42 may be fabricated from a fractured plastic film such as VISIQUEEN plastic films and/or VISIPOR plastic films available from Tredagar Film Products, a division of Tredagar Industries located at 110 Boulders Parkway, Richmond, Va. 23225.

Fractured plastic films are often constructed with small apertures which allow gases to pass therethrough but prevent liquids from passing due to the liquid's relatively high surface tension and the dimension/configuration of the apertures. One side of such fractured plastic films typically may have a generally smooth surface and the other side typically may have a generally rough surface such that liquids may pass from the side with the smooth surface through the small apertures to the side with the rough surface. Such fractured plastic films often restrict liquids from passing from the side with the rough surface through the apertures to the side with the smooth surface while allowing liquids to pass in the opposite direction.

When face mask 20 or other disposable clean room products include an inner layer of material formed from such fractured plastic films, the smooth surface is preferably disposed adjacent to the wearer to allow water vapor or moisture to escape from the wearer and to place the smooth surface in contact with any exposed portions of the wearer's skin. Orienting such fractured plastic films with the respective rough surface disposed away from the wearer also prevents the passage of potentially hazardous liquids from the exterior of a disposable clean room product through the respective disposable clean room product into contact with the wearer or user. A more complete description of the construction and operation of such fractured plastic films can be found in U.S. Pat. No. 3,929,135 entitled Absorptive Structure Having Tapered Capillaries, issued on Dec. 10, 1975 to Hugh A. Thompson.

For the embodiment of the present invention shown in FIGS. 1 and 2, a portion of inner layer 42 extends from filter body 24 adjacent to bottom edge 38. This portion of inner layer 42 forms gap guard 43 which prevents any particulate matter on the neck of wearer 22 from escaping into the surrounding clean room environment. For some applications, gap guard 43 may be formed as an extension from the respective outer layer 40. Alternatively, gap guard 43 may be formed from non-particulating disposable material which is different from the material used to form layers 40, 42 and 44.

One or more intermediate layers 44 of filter media may be disposed between outer layer 40 and inner layer 42. The present invention allows selecting the number of intermediate layers 44 and the type of material used to form each intermediate layer 44 depending upon the intended clean room environment for the resulting face mask 20. In FIG. 2, filter body 24 is shown with only one intermediate layer 44 which function as a filter media for face mask 20. Intermediate layer 44 may be constructed from meltblown polypropylene, extruded polycarbonate, a melt-blown polyester, or melt-blown urethane.

For clean room environments with very low levels of allowable particulate contamination, intermediate layer 44 may be formed from a fractured plastic film such as an expanded polytetrafluoroethylene (PTFE) membrane. Fractured plastic films such as expanded polytetrafluoroethylene (PTFE) membranes are sometimes used as filter media since the number and size of the openings provided within the respective fractured plastic film may be varied to provide required filtration protection and a high degree of breathability appropriate for face mask 20 or a relatively low degree of breathability appropriate for head covering 230 shown in FIG. 11. Examples of such materials are manufactured by W.L. Gore & Associates and sold with the trademark GORE-TEX®. A more complete description of the construction and operation of such fractured plastic films can be found in U.S. Pat. No. 3,953,566 entitled Process for Producing Porous Products, issued on Apr. 27, 1976 to Robert W. Gore, and U.S. Pat. No. 4,187,390 entitled Porous Products and Process Therefor, issued on Feb. 5, 1980 to Robert W. Gore.

As shown in FIG. 2, top edge 34 of face mask 20 preferably includes edge binder 46 that extends across the open end of face mask 20 and covers malleable strip 36. In a similar manner, bottom edge 38 of face mask 20 preferably includes edge binder 48. Edge binders 46 and 48 may be fabricated from a spun-laced polyester or thermally bonded bicomponent materials. For clean room environments with very low levels of allowable particulate contamination, edge binders 46 and 48 may be formed from non-porous materials such as polypropylene, polyethylene and/or polyolefin plastic films. Porous materials may also be used to form such edge binders if they have a satisfactorily low particulate emission rate. Similarly, edge binders (not expressly shown) may be placed along edges 50, 52 and 54 to further reduce particulate contamination from the resulting face mask 20.

For some applications, intermediate layer 44 may be formed from a barrier material that is gas permeable and permits gas (air) to pass through filter body 24 in both directions and is impermeable to liquid passing through face mask 20 from the exterior of filter body 24. The use of such barrier materials to form intermediate layer 44 is particularly important when face mask 20 is worn in a clean room environment where wearer 22 may be exposed to potentially hazardous chemicals and/or fluids including body fluids such as blood, urine and saliva containing highly contagious germs and viruses. Contact of AIDS contaminated body fluids with another person's source of body fluids, such as the eyes, nose and mouth, may transmit the disease. Therefore, it is often preferable to fabricate layer 44 from material which is resistant to the passage of liquids through filter body 45 to prevent body fluids from contacting the nose and mouth of wearer 22. Also, more than one intermediate layer 44 may be used to provide the desired level of resistance to liquid penetration. Previously described VISIPOR and VISIQUEEN plastic films are examples of such materials.

Figure 3:
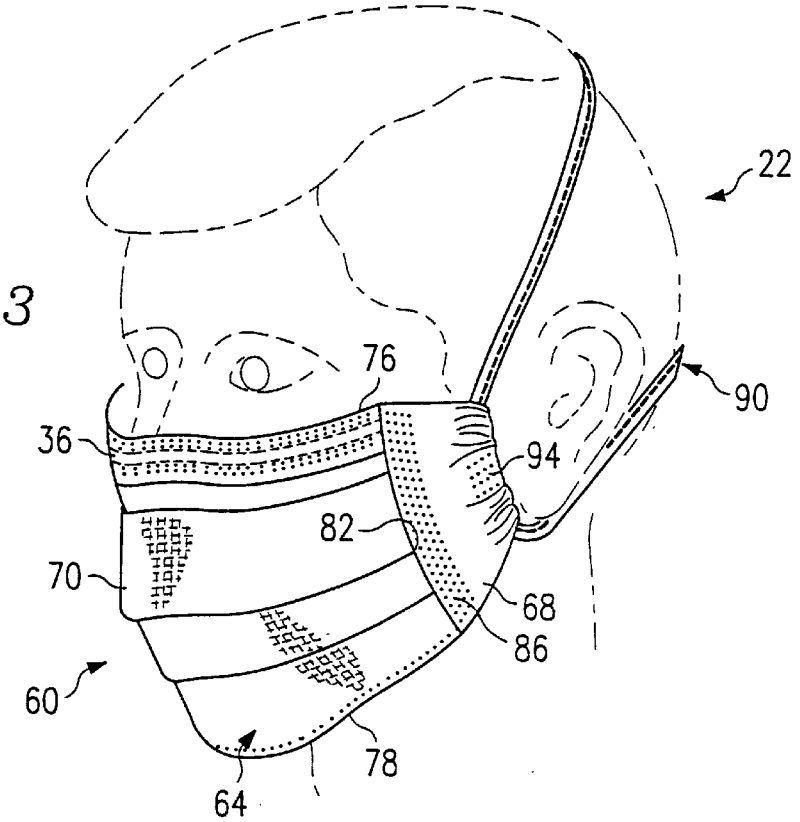
FIG. 3 is a schematic drawing showing a perspective view of another type of disposable face mask worn on the head of a wearer and fabricated from non-particulating or low particulating materials in accordance with teachings of the present invention for use in a clean room environment.
Figure 4:
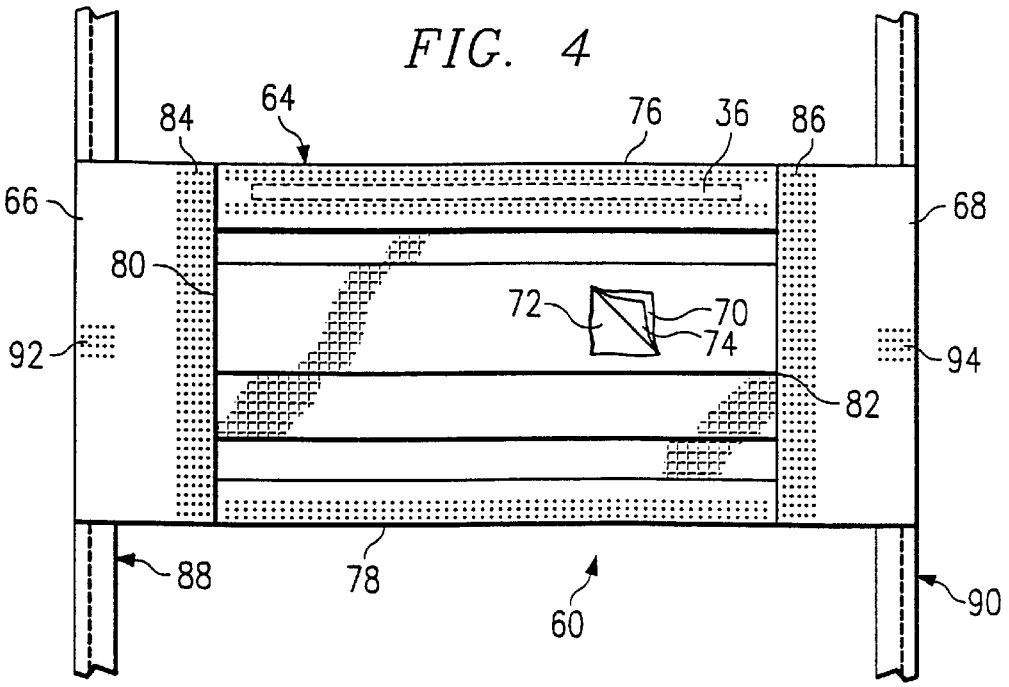
FIG. 4 is a schematic drawing with portions broken away showing a front plane view of the face mask of FIG. 3.

Other types of microporous or fractured plastic films and melt-blown polypropylene and polyethylene nonwoven materials which include small apertures to prevent liquids from passing therethrough due to the liquid's relatively high surface tension may be satisfactorily used with the present invention. U.S. Pat. No. 5,150,703 entitled Liquid Shield Visor for a Surgical Mask with a Bottom Notch to Reduce Glare, issued on Sep. 29, 1992 to Hubbard, et al. and U.S. Pat. No. 4,920,960 entitled Body Fluids Barrier Mask, issued on May 1, 1990 to Hubbard, et al. provide additional information on materials which may be used for layers 40, 42 and 44 and face masks constructed with such materials. These patents are incorporated by reference for all purposes within this application. Face mask 60 incorporating an alternative embodiment of the present invention is shown in FIGS. 3 and 4.

Face mask 60 includes filter body 64 with flaps 66 and 68 extending respectively from each side of filter body 64. For some applications, filter body 64 may be fabricated in general as described in U.S. Pat. No. 4,635,628 entitled Surgical Face Mask with Improved Moisture Barrier and U.S. Pat. No. 4,969,457 entitled Body Fluids Barrier Mask. Both of these patents are incorporated by reference for all purposes within this application.

Flaps 66 and 68 may be formed from fluid impervious material and folded with a generally U-shaped cross section. For other applications, the same types of breathable non-particulating materials may be used to form both filter body 64 and flaps 66 and 68. For still further applications, flaps 66 and 68 may be formed from resilient and/or stretchable materials. Such resilient materials include thermoplastic rubber compounds which may be extruded or injection molded as strips or sheets of material. An example of such thermoplastic rubber compounds is available under the trademark KRATON®from Shell Oil Company.

Filter body 64, flaps 66 and 68 may be designed to prevent or retard the passage of liquids from the exterior of face mask 60 to the face of wearer 22 while allowing air to flow in both directions through filter body 64. It is extremely difficult to construct a face mask that will fit the facial configuration of all wearers without constructing each mask specifically for each individual face. The use of flaps 66 and 68 greatly increases the different sizes and types of faces which can be effectively protected by face mask 60. Forming flaps 66 and 68 from suitable resilient or stretchable material further improves facial fit with a large number of wearers. Filter body 64 may comprise a plurality of pleats which allow expansion of filter body 64 to cover the mouth and nose of wearer 22. The number of pleats formed in filter body 64 may be varied to provide the desired fit with the face of wearer 22. For some applications filter body 64 may be formed without pleats. For other applications, filter body 64 may be formed with non-collapsing face panels such as shown in U.S. Pat. No. 4,606,341 entitled Non-Collapsible Surgical Face Mask. U.S. Pat. No. 4,606,341 is incorporated by reference for all purposes within this application. For still further applications, filter body 64 may be formed from only one layer of non-particulating material or from multiple layers of non-particulating material. Flaps 66 and 68 allow selecting a wide variety of materials which provide the desired breathability and protection for wearer 22 while, at the same time, resulting in little or no particulate contamination from wearing face mask 60 in a clean room environment.

For the example represented by the cutaway portion of FIG. 4, filter body 64 includes outer layer 70, inner layer 72 and at least one intermediate layer 74. Outer layer 70 may be fabricated from the same materials as previously described with respect to outer layer 40 of face mask 20. Inner layer 72 may be fabricated from the same materials as previously described with respect to inner layer 42 of face mask 20. Intermediate layer 74 may be fabricated from the same materials as previously described with respect to intermediate layer 44 of face mask 20. Depending upon the specific clean room environment in which the resulting face mask 60 will be used, outer layer 70, inner layer 72, and/or intermediate layer 74 may be fabricated from non-particulating materials such as a fractured plastic film which is capable of differentiating between gasses and liquids. Such fractured plastic films often have small apertures which prevent liquids with a relatively high surface tension from passing therethrough yet will allow gases with a low surface tension to pass therethrough. It is preferable to have the apertures as large as possible to allow easy breathing, and yet small enough to retard or prevent the escape of particulate contamination and the flow of liquids therethrough.

Outer layers 40 and/or 70 may sometimes be referred to as cover stock. For some applications the exterior surface of layers 40 and/or 70 may be treated, for example, by spraying with a liquid repellent to render the external surface of the respective outer layers 40 and 70 resistant to liquid penetration.

Filter body 64 may be formed by bonding layers 70, 72 and 74 with each other in a generally rectangular configuration. Such bonding is preferably provided along top edge 76, bottom edge 78 and lateral edges 80 and 82, respectively. The corresponding bonded areas may be formed by sewing, adhesive, heat sealing, welding, ultrasonic bonding and/or any other suitable bonding procedure. For clean room environments with very low levels of allowable particulate contamination, a gap guard (not expressly shown) similar to gap guard 43 may be attached to bottom edge 78 of filter body 64.

Flaps 66 and 68 are preferably integrally attached to filter body 64 as part of the respective bonded areas 84 and 86. Flaps 66 and 68 are preferably formed from fluid impervious material such as a non-particulating plastic membrane and folded with a U-shaped configuration to form an opening to receive tie strips 88 and 90 therein. Bonded areas 92 and 94 are preferably used to secure the approximate mid-point of tie strips 88 and 90 with corresponding mid-points of flaps 66 and 68.

Top edge 76 of filter body 64 preferably includes an elongated malleable member 36 provided so that top edge 76 of filter body 64 may be configured to closely fit the contours of the nose and cheeks of wearer 22. Top edge 76, bottom edge 78 and flaps 66 and 68 cooperate with each other to define the periphery of face mask 60 which contacts the face of wearer 22. Flaps 66 and 68 substantially increase the area of contact with the face of wearer 22 as compared to a face mask having only top edge 76, bottom edge 78 and lateral sides 80 and 82 in contact with the face of wearer 22.

Positioning tie strips 88 and 90 as shown in FIG. 3 results in compressing or gathering respective flaps 66 and 68 to form a flat, flange type fluid barrier with adjacent portions of the face of wearer 22. Also, securing tie strips 88 and 90 in this manner urges top edge 76 and bottom edge 78 into fluid sealing engagement with the contours of the face of wearer 22. Surgical tie strips 88 and 90 may be positioned on the head of wearer 22 to provide the optimum full angle and the optimum amount of force to form the desired fluid barrier between the periphery of face mask 60 and the face of wearer 22. It is important that bottom edge 78 and the chin of wearer 22 and top edge 76 and the nose and cheeks of wearer 22 fit very closely since any leaks result in bypass or blow-by of fluids either entering face mask 60 or being discharged from face mask 60 during use by wearer 22.

Various types of securing means may be used to attach a face mask incorporating teachings of the present invention to the face of wearer 22. Head bands 26 and 28 shown in FIG. 1 and tie strips 88 and 90 shown in FIG. 4 represent only two of these alternative securing means. Elastic ear loops, such as shown in U.S. Pat. No. 4,802,473 entitled Face Mask with Ear Loops, may also be satisfactorily used with the present invention. U.S. Pat. No. 4,802,473 is incorporated by reference for all purposes within this application. Tie strips 88 and 90 may be replaced by a continuous loop of resilient material (not expressly shown) which is disposed within flaps 66 and 68. By forming tie strips 88 and 90 from resilient non-particulating disposable materials, the periphery of face mask 60 will maintain the desired fluid barrier with the face of wearer 22 over a relatively long period of time. Talking and other activities by wearer 22 will not compromise the integrity of the associated fluid barrier.

FIGS. 5–8 show alternative embodiments of the present invention in which one or more layers of non-particulating or low particulating fractured plastic films and other materials may be bonded with each other for use in fabricating disposable clean room products in accordance with teachings of the present invention. Laminated material blanks 110, 130, 150 and 170, as shown respectively in FIGS. 5–8, represent an intermediate step in the fabrication of disposable clean room products from one or more non-particulating or low particulating fractured plastic films and treated nonwoven materials in accordance with teachings of the present invention.

Figure 5:
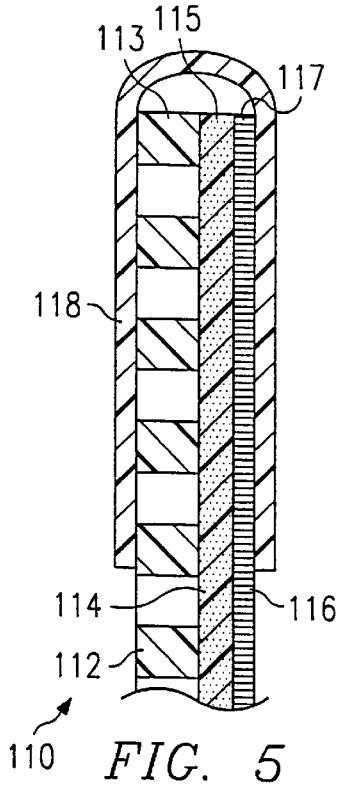
FIG. 5 is an enlarged schematic drawing in section with portions broken away showing three layers of non-particulating or low particulating materials with a binder extending over adjacent edges of the three material layers satisfactorily for use in fabricating disposable clean room products in accordance with teachings of the present invention.
Figure 6:
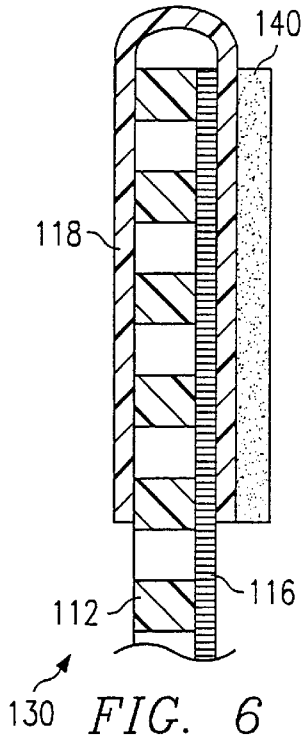
FIG. 6 is an enlarged schematic drawing in section with portions broken away showing the three layers of non-particulating or low particulating materials and the edge binder of FIG. 5 along with a strip of soft, nonwoven material disposed adjacent thereto for use in fabricating disposable clean room products in accordance with teachings of the present invention.
Figure 7:
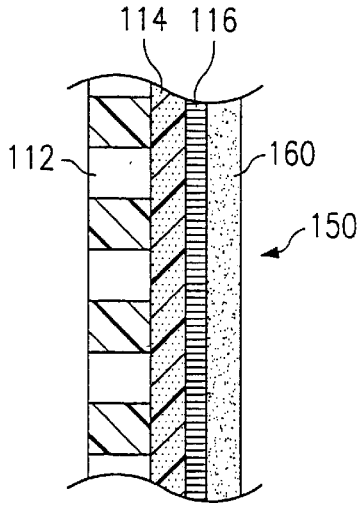
FIG. 7 is an enlarged schematic drawing in section with portions broken away showing three layers of non-particulating or low particulating materials with a layer of soft, nonwoven material disposed adjacent thereto for use in fabricating disposable clean room products in accordance with teachings of the present invention.
Figure 8:
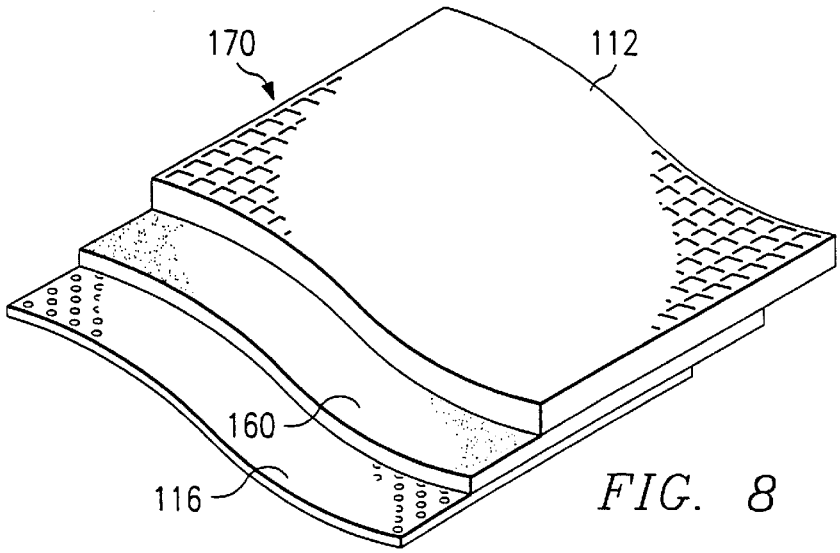
FIG. 8 is a schematic drawing showing an isometric view with portions broken away of three layers of soft, non-particulating or low particulating materials which may be used to fabricate disposable clean room products in accordance with teachings of the present invention.

As shown in FIG. 5, laminated material blank 110 includes layer 112 formed from a first fractured plastic film, layer 114 formed from a second fractured plastic film and layer 116 formed from a third fractured plastic film. Layers 112, 114 and 116 may have various geometric configurations such as rectangular, square, circular, oval, or any other geometric configuration as appropriate for the resulting disposable clean room product. Layers 112, 114 and 116 each have respective edges 113, 115 and 117 disposed adjacent to each other. Alternatively, layer 112 or layer 116 could be extended and rolled back over the other layers instead of using separate edge binder 118 formed from a separate strip of material.

Edge binder 118 is disposed over and extends along edges 113, 115 and 117. Portions of edge binder 118 are attached with portions of layers 112 and 116 adjacent to respective edges 113 and 117. Portions of layers 112, 114, and 116 adjacent to respective edges 113, 115, and 117 along with adjacent portions of edge binder 118 may be bonded with each other using various bonding techniques including, but not limited to, hot or cold adhesive bonding, laser bonding, radio frequency bonding, ultrasonic bonding, heat and pressure bonding, and impulse bonding. Sewing, particularly with a nonfilament thread, may be used in less stringent particulate contamination applications. For many applications ultrasonic bonding techniques may be satisfactorily used to secure portions of edge binder 118 with adjacent portions of layers 112, 114, and 116 to provide essentially a non-particulating bond between adjacent portions of layers 112, 114, 116 and edge binder 118.

Some commercially available plastic films have a tendency to flake or to release particulate matter during extended periods of wear and/or use. Layers 112, 114, and 116 are preferably formed from non-particulating or low particulating fractured plastic film. The desired non-particulating or low particulating material may be obtained by selecting the appropriate plastic compound used to form the respective fractured plastic film. For example, high density polyethylene is often less likely to flake or to emit particulate contamination as compared with low density polyethylene. Alternatively, a sheet or roll of fractured plastic film may be cleaned with a suitable fluid prior to forming laminated material blank 110. For example, a sheet of fractured plastic film may be exposed to a source of filtered air or other gases such as nitrogen to remove loose particulate contamination immediately prior to bonding with the other fractured plastic films used to form layers 114 and 116. Depending upon the specific type of fractured plastic film, other cleaning fluids such as demineralized water or a chemical solvent may also be used to remove particulate contamination from each sheet of fractured plastic film prior to fabricating laminated material blank 110.

For clean room environments with very low levels of allowable particulate contamination, each of the fractured plastic films used to form laminated material blank 110 maybe formed in a respective clean room environment. The fabrication of laminated material blank 110 and the resulting disposable clean room product may also be performed in a clean room environment.

Laminated material blank 130 is similar to laminated material blank 110 except intermediate layer 114 is not included as part of laminated material blank 130. Also, a strip of material 140 is attached to and extends along one side of edge binder 118 opposite from layer 116. Strip 140 may be formed from soft, nonwoven material for those applications in which laminated material blank 130 is used to fabricate a disposable clean room product which will contact exposed portions of a wearer's skin. Alternatively, strip 140 may be formed from a strip of foam type material associated with fog free face mask. A thin layer of adhesive (not expressly shown) may also be placed on strip 140 to form a releasable bond with exposed portion of a wearer's skin. U.S. Pat. No. 4,635,628 entitled Surgical Face Mask With Improved Moisture Barrier shows one type of foam strip which may be satisfactorily used with the present invention.

Laminated material blank 150 includes previously described layers 112, 114 and 116. In addition, layer 160 of nonwoven material is disposed on one side of layer 116 opposite from intermediate layer 114. Laminated material blank 150 may be satisfactorily used for applications in which a substantial portion of the disposable clean room product will contact exposed portions of the wearer or user's skin. Both strip 140 of soft, nonwoven material and layer 160 of soft, nonwoven material are preferably disposed adjacent to the wearer or user such that the associated layers 112, 114 and 116 of fractured plastic film will prevent the escape of particulate contamination from strip 140 and/or layer 160 into the surrounding clean room environment. Both laminated material blank 150 and 170 preferably include a bonded border with edge binder 118.

For some applications, strip 140 and/or layer 160 may be formed from non-particulating or low particulating, treated nonwoven material. During the process of manufacturing nonwoven materials, various types of chemical treatments may be applied to the nonwoven fibers to prevent or substantially reduce the emission of loose fibers. Examples of such chemical treatments include plastic coating and/or acrylic coating of the nonwoven materials. Also, various mechanical processes such as heavy calendaring and/or heating may be applied to the loose fibers during the manufacture of the associated nonwoven material to reduce the particulate emission rate associated with the finished, treated nonwoven material. Depending upon the intended application for the resulting nonwoven material, both chemical and mechanical treatments may be combined to provide either a non-particulating or low particulating, treated nonwoven material.

Laminated material blank 170 includes layer 112 and layer 116 with layer 160 disposed therebetween. Layer 160 may be formed from a wide variety of nonwoven materials depending upon the intended application for the resulting clean room disposable product. Layers 112 and 116 are formed from fractured plastic films and cooperate with each other to block any particulate contamination that might be dislodged from nonwoven material layer 160 from escaping into the adjacent clean room environment. Laminated material blank 170 may be satisfactorily used to form a disposable clean room wipe. An example of such a wipe is shown in U.S. Pat. No. 4,888,229 entitled Wipers for Clean Room Use. This patent is incorporated by reference for all purposes in this application.

For some applications, laminated material blank 170 may be particularly useful for fabricating a liquid absorbing wipe for use in a clean room environment. For example, both layers 112 and 116 may be formed from non-particulating fractured plastic film which allows liquids to flow from the exterior of the associated layer 112 and 116 into layer 160 and restricts the flow of liquids from layer 160 outwardly through layers 112 and 116. For some applications, layer 160 may be formed from absorbent or even super absorbent materials. For other applications, a portion of layer 112 and/or 116 maybe formed from a non-particulating fractured plastic film which allows fluids to escape from layer 160. As a result, a cleaning fluid could be released from one portion of the resulting disposable clean room wipe and absorbed by other portions of the same clean room disposable product. Face veil 190 is shown in FIG. 9 on the head of wearer 22.

Face veil 190 maybe formed from laminated material blanks 110, 130, 150 or 170 in accordance with teachings of the present invention. For some applications it may be preferable to form face veil 190 from laminated material blank 130. Alternatively, face veil 190 may be formed from a single layer of fractured plastic film.

Face veil 190 has a generally rectangular configuration. Headband 194 is provided to secure face veil 190 on the head of wearer 22 with top edge 192 extending across the nose and cheeks of wearer 22. Top edge 192 is defined in part by edge binder 118. If desired, malleable member 36 may also be disposed within edge binder 118 adjacent to top edge 192. Face veil 190 may be positioned with layer 116 and strip 140 of soft, nonwoven material disposed adjacent to the face of wearer 22 for increased comfort during long term wear of face veil 190. Placing strip 140 of nonwoven material on the interior surface of face veil 190 substantially reduces or eliminates possible escape of particulate contamination to the surrounding clean room environment. Face veil 190 may typically provide only 50% of the filtration capability of face mask 20 and/or 60.

Beard cover 210 is shown in FIG. 10 on the head of wearer 22. Beard cover 210 has the general configuration of a pouch with opening 212 sized to fit over the chin and jaws of wearer 22 and to receive a beard therein. Opening 212 is preferably defined in part by edge binder 118. Beard cover 210 may be formed from one or more layers of fractured plastic film in accordance with teaching of the present invention. For some applications beard cover 210 may be formed from laminated material blank 130.

Head cover 230 is shown in FIG. 11 on the head of wearer 232. Head cover 230 is often referred to as a bouffant style head cover or cap. Head cover 230 may be fabricated using previously described laminated material blanks 110, 130, 150 and 170. A strip of resilient material (not expressly shown) may be incorporated within edge binder 118. Laminated material blanks 110, 130, 150 and 170 may also be used to fabricate other types of head covers such as shown in U.S. Pat. No. 5,008,961 entitled Sanitary Head Covering and Method of Manufacture. This patent is incorporated by reference for all purposes within this application.

Sleeve protector 250 is shown in FIG. 12 on the arm of wearer 22. Sleeve protector 250 has a generally cylindrical configuration with opening 252 and 254 at opposite ends thereof. Openings 252 and 254 are preferably defined in part by respective edge binders 118. Each opening 252 and 254 preferably includes resilient material (not expressly shown) to secure sleeve protector 250 with the arm of wearer 22. A leg protector (not expressly shown) may also be formed from fractured plastic films in accordance with teachings of the present invention similar to sleeve protector 250. Some of the principal differences between sleeve protector 250 and a leg protector will be increased dimensions and a configuration appropriate for a human leg. Shoe cover 270 is shown in FIG. 13 on the foot of wearer 22.

Shoe cover 270 may be formed from laminated material blanks 110, 130, 150 or 170. Other types of fractured plastic films may also be used to form shoe cover 270. Shoe cover 270 preferably includes opening 272 which allows shoe cover 270 to fit over the foot of wearer 22. Opening 272 is defined in part by edge binder 118. Opening 272 preferably includes a strip of resilient material (not expressly shown) to maintain shoe cover 270 on the foot of wearer 22.

Many clean room environments are associated with the fabrication and assembly of complex, delicate electronic components. Depending upon the type of environment, some fractured plastic films may have a tendency to generate static electricity. The uncontrolled discharge of such static electricity can seriously damage or destroy VLSI circuits and similar electronic components. Therefore, one or more fractured plastic film layers 112, 114 and 116 of laminated material blanks 110, 130, 150 and 170 may be treated with an appropriate anti-static coating to prevent the buildup of static electricity within the resulting disposable clean room product.

Incorporating strip 140 and/or layer 160 of an appropriate nonwoven material as part of a disposable clean room product as previously described with respect to laminated material blanks 130, 150 and 170 may also be used to prevent the buildup of static electricity in the associated fractured plastic film layers. Other nonwoven materials maybe treated with an appropriate antistatic coating. In addition, one or more charcoal threads (not expressly shown) or very small diameter copper threads (not expressly shown) may be incorporated within either nonwoven material strip 140 or nonwoven material layer 160 to further aid in preventing the buildup of undesirable static electricity in the associated fractured plastic films.

For clean room environments with very low levels of allowable particulate contamination, disposable clean room products fabricated in accordance with teachings of the present invention may be cleaned by using pressurized filtered air wash or other suitable cleaning fluids. For some applications, a series of HEPA filters may be used to clean the air prior to washing the finished disposable clean room product. The resulting disposable clean room products are preferably packaged and sealed in a clean room environment for shipment to the end user.

Particulate contamination from a disposable clean room product may be produced by abrasion from rubbing on a wearer, rubbing on working surfaces within the clean room environment and/or rubbing portions of the disposable clean room product with each other. Such abrasion will have a tendency to dislodge any loose, foreign particulate matter carried by the respective disposable clean room product and will also wear or yield the associated material layers to release particulate contamination. Air flow and air currents within a clean room environment may also dislodge any loose particulate matter from a clean room disposable product. Breathing by a wearer or heating of a disposable clean room product may dislodge loose particulate matter in the clean room environment. Disposable clean room products are preferably tested to more closely approximate the actual performance with respect to particulate contamination generated by the respective disposable clean room product.

Samples of clean room products fabricated in accordance with the teaching of the present invention are preferably placed in a sealed chamber with a closed air circulation system. Air supplied to the sealed chamber preferably flows through a series of HEPA filters to reduce particulate contamination to a very low level such as 1–10 particles per cubic meter. Exhaust air flowing out of the sealed chamber is preferably directed through a particulate counter which will sample the exhaust air on a selected periodic basis. The frequency of sampling is selected depending upon the type of disposable clean room product being tested and the length of time that the clean room product remains in the sealed chamber. For example, for a test lasting approximately eight hours, a particulate count may be taken every 15 minutes in the exhaust air. For a test lasting only one hour, a particulate sample of the exhaust air may be taken every five minutes.

Within the sealed chamber, each disposable clean room product is tested in a manner which will closely approximate its intended use. For example, when testing shoe cover 270, the sealed chamber will preferably include a mechanical foot to simulate walking in a clean room environment. Shoe cover 270 would then be placed on the mechanical foot and the test conducted for a representative time, such as eight hours that a worker might continuously wear a disposable shoe cover in a clean room environment. In a similar manner, a fixture could be provided in a sealed chamber to rub portions of sleeve protector 250 against each other to simulate abrasion resulting from normal arm movements of a worker in a clean room environment. Face masks 20 and 60 may be placed on a suitable form or on the head of a mannequin in a sealed chamber and similarly tested under conditions which closely approximate normal breathing of wearer 22 and/or abrasion with the face of wearer 22 while working in a clean room environment.

For clean room environments with very low levels of allowable particulate contamination, face masks 20, 60 and/or other disposable clean room products may be fabricated with an outer layer of a first fractured plastic film such as previously described DELNET® materials, an intermediate layer of a second fractured plastic film such as previously described GORE-TEX® membranes and an inner layer of a third fractured plastic film such as previously described VISIPOR and/or VISIQUEEN plastic films. The resulting disposable clean room product has good breathability while, at the same time, substantially reducing or substantially eliminating particulate emissions from the resulting disposable clean room product. For clean room environments with very low levels of allowable particulate contamination and potentially hazardous conditions such as dangerous airborne pathogens, or harmful chemical compounds, a disposable clean room product may be fabricated with an outer layer formed from a first fractured film material such as DELNET® materials and an inner layer formed from a second fractured film material such as a VISIPOR and/or VISIQUEEN films. Depending upon the type of potentially hazardous condition which may be present in the clean room environment, an intermediate layer of melt blown polypropylene and/or melt blown polyethylene may be disposed between the inner layer and outer layer of fractured plastic films. For some corrosive chemical environments, an intermediate layer formed in part from encapsulated fiberglass may be used. Thus, the present invention allows fabricating a disposable clean room product with the desired level of breathability and protection for the wearer or user while, at the same time, substantially reducing or eliminating particulate emissions from the resulting disposable clean room product.

In addition to the previously discussed materials, disposable clean room products may be manufactured using a wide variety of nonwoven materials and/or microporous plastic films. The teachings of the present invention allow incorporating new, state of the art materials into the fabrication of disposable clean room products.

Although the present invention has been described in detail with respect to alternative embodiments, various changes and modifications may be suggested to one skilled in the art, and it should be understood that various changes, substitutions, and alterations can be made hereto without departing from the spirit and scope of the invention as defined by the appended claims.

What is claimed is:

1. A disposable clean room product comprising:

at least two layers of non-particulating fractured plastic film wherein a first layer of said film is disposed adjacent to a second layer of said film;

each layer of non-particulating fractured plastic film having a generally matching configuration with at least one edge of the first layer disposed adjacent to one edge of the second layer; and a non-particulating edge binder extending over the adjacent edges of the non-particulating fractured plastic film layers.

2. The disposable clean room product of claim 1 further comprising a strip of nonwoven material disposed on and attached to the edge binder.

3. The disposable clean room product of claim 1 selected from the group consisting of a face mask, a respirator, a face veil, a beard cover, a head cover, a sleeve protector, and a shoe cover.

4. The disposable clean room product of claim 1 wherein at least one of the layers of non-particulating fractured plastic film is formed from material previously cleaned with a fluid prior to fabricating the disposable clean room product.

5. The disposable clean room product of claim 1 further comprising a layer of nonwoven material disposed between the first layer of non-particulating fractured film and the second layer of non-particulating fractured plastic film.

6. The disposable clean room product of claim 5 wherein the nonwoven material layer has an anti-static coating.

7. The disposable clean room product of claim 5 further comprising at least one small diameter electrically conductive thread disposed within and forming a part of the nonwoven material layer.

8. The disposable clean room product of claim 1 further comprising a third layer of non-particulating fractured film disposed between the first layer of non-particulating fractured film and the second layer of non-particulating fractured film.

9. The disposable clean room product of claim 8 further comprising a layer of soft, nonwoven material disposed on the second layer of non-particulating fractured film opposite from the third layer of non-particulating fractured plastic film.

10. The disposable clean room product of claim 1 wherein at least one of the layers of non-particulating fractured plastic film has one side with a smooth surface, an opposite side with a rough surface, and a plurality of apertures extending throughout allowing the flow of liquids from the smooth-surface side to the rough-surface side and restricting the flow of liquids from the rough-surface side to smooth-surface side.

11. A disposable clean room product fabricated from at least two layers of fractured plastic film comprising:

a first layer of fractured plastic film disposed adjacent to a second layer of fractured plastic film;

each layer of fractured plastic film having a generally matching configuration with each edge of the first layer disposed adjacent to a corresponding edge of the second layer; and a non-particulating bond formed between the adjacent edges of the first layer and the second layer.

12. The disposable clean room product of claim 11 wherein each layer of fractured plastic film is washed by filtered air prior to bonding with said respective other layer of fractured plastic film.

13. The disposable clean room product of claim 11 selected from the group consisting of a face mask, a respirator, a face veil, a beard cover, a head cover, a sleeve protector, and a shoe cover.

14. The disposable clean room product of claim 11 wherein at least one of the layers of fractured plastic film has an anti-static coating.

15. The disposable clean room product of claim 11 further comprising a layer of fiberglass material disposed between the first layer of fractured film and the second layer of fractured plastic film.

16. The disposable clean room product of claim 11 further comprising a nonporous edge binder extending over and bonded with the adjacent edges of each layer.

17. The disposable clean room product of claim 11 further comprising a layer of nonwoven material.

18. The disposable clean room product of claim 11 further comprising a third layer of fractured plastic film disposed between the first layer of fractured plastic film and the second layer of fractured plastic film.

19. The disposable clean room product of claim 18 further comprising a layer of soft, nonwoven material disposed on the second layer of fractured plastic film opposite from the third layer of fractured plastic film.

20. The disposable clean room product of claim 1 wherein:

at least one of the layers of non-particulating fractured plastic film has one side with a smooth surface, an opposite side with a rough surface, and a plurality of apertures extending throughout allowing the flow of liquids from the smooth-surface side to the rough-surface side and restricting the flow of liquids from the rough-surface side to smooth-surface side; and wherein the layer of fractured plastic film with smooth surface is disposed on the interior of the disposable clean room product whereby the smooth surface may contact a wearer.

21. A disposable clean room product comprising:

at least one layer of low particulating, treated nonwoven material disposed adjacent to a layer of low particulating fractured plastic film; and said layer of low particulating, treated nonwoven material and low particulating fractured plastic film having a generally matching configuration with at least one edge of the low particulating, nonwoven material disposed adjacent to one edge of the low particulating fractured plastic film; and a low particulating bond formed between the adjacent edges of the low particulating, treated nonwoven material and the low particulating fractured plastic film.

22. A disposable clean room wipe comprising:

a first layer of fractured plastic film having a smooth surface and a rough surface with a plurality of apertures extending therethrough to air flow in both directions through the fractured plastic film layer and to block the flow of liquids from the rough surface to the smooth surface through the aperture;

a second layer of fractured plastic film having a smooth surface and a rough surface with a plurality of apertures extending therethrough to allow air flow in both directions through the fractured plastic film layer and to block the flow of liquids from the rough surface to the smooth surface through the apertures, a layer of absorbent nonwoven material disposed between the first layer of fractured plastic film and the second layer of fractured plastic film, adjacent edges of the first layer of fractured plastic film and the second layer of fractured plastic film bonded with each other to prevent the escape of particulate contamination from the layer of absorbent material; and the first layer of fractured plastic film and the second layer of fractured plastic film oriented with respect to the layer of absorbent material whereby a liquid may flow from the exterior of the disposable clean room wipe into the absorbent material and the liquid is restricted from flowing outwardly from the absorbent material layer.

* * * * *